US007937980B2

(12) United States Patent
Hessberger et al.

(10) Patent No.: US 7,937,980 B2
(45) Date of Patent: May 10, 2011

(54) DRAWING MACHINE AND METHOD FOR DRAWING AN ELONGATED WORKPIECE

(75) Inventors: Dirk Hessberger, Aachen (DE); Thomas Cmiel, Aachen (DE); Heiner Kudrus, Eupen (BE)

(73) Assignee: SMS Schumag GmbH & Co. KG, Aachen (DE)

( * ) Notice: Subject to any disclaimer, the term of this patent is extended or adjusted under 35 U.S.C. 154(b) by 886 days.

(21) Appl. No.: 11/631,254

(22) PCT Filed: Jun. 28, 2005

(86) PCT No.: PCT/DE2005/001145

§ 371 (c)(1),
(2), (4) Date: Jan. 11, 2007

(87) PCT Pub. No.: WO2006/002613

PCT Pub. Date: Jan. 12, 2006

(65) Prior Publication Data

US 2007/0245795 A1 Oct. 25, 2007

(30) Foreign Application Priority Data

Jun. 30, 2004 (DE) ..... 10 2004 031 843

(51) Int. Cl.
*B21C 1/30* (2006.01)
*B65H 20/00* (2006.01)

(52) U.S. Cl. ..... 72/291; 226/172

(58) Field of Classification Search ..... 72/284, 72/287, 289, 291, 419, 422, 423, 426, 450; 264/288.4; 425/392; 198/606, 626.5, 626.6, 833; 226/172, 173, 190, 170, 171
See application file for complete search history.

(56) References Cited

U.S. PATENT DOCUMENTS

| | | | | |
|---|---|---|---|---|
| 1,447,644 | A | 3/1923 | Chapman | |
| 3,945,547 | A | 3/1976 | Ledebur | |
| 5,816,967 | A * | 10/1998 | Ledvina et al. | 474/84 |
| 6,450,386 | B1 * | 9/2002 | Hessberger et al. | 226/172 |

FOREIGN PATENT DOCUMENTS

| | | | |
|---|---|---|---|
| DE | 148 593 | C | 6/1981 |
| DE | 198 57 288 | A1 | 6/2000 |
| DE | 198 57 781 | A1 | 6/2000 |
| DE | 101 22 340 | A1 | 11/2002 |
| DE | 101 41 638 | A1 | 3/2003 |
| EP | 0 548 723 | A1 | 6/1993 |
| GB | 1 553 279 | A | 7/1976 |
| JP | 04 064756 | A | 2/1992 |
| JP | 06 300116 | A | 10/1994 |

OTHER PUBLICATIONS

International Search Report.

* cited by examiner

*Primary Examiner* — Teresa M Ekiert
(74) *Attorney, Agent, or Firm* — Collard & Roe, P.C.

(57) ABSTRACT

A method for the drawing of a longitudinal workpiece wherein drawing forces required for the drawing are applied by means of at least a sprocket chain comprising link plates wherein the drawing forces are introduced from the workpiece via the link plates into the sprocket chain as a result of which the latter can be constructed lighter and apply greater drawing forces.

27 Claims, 6 Drawing Sheets

Figure 1:
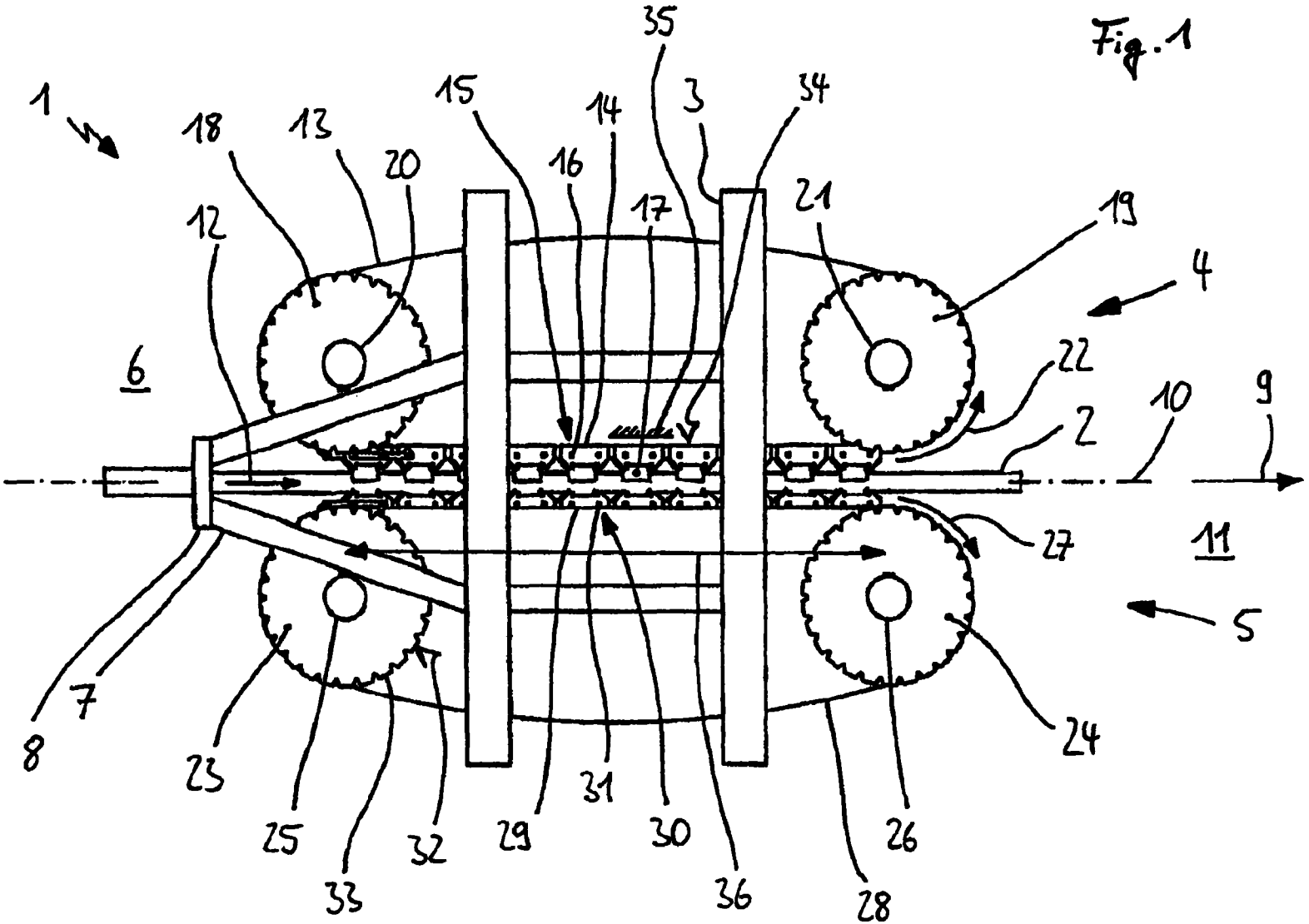

1
2
3
4
5
6
7
8
9
10
11
12
13
14
15
16
17
18
19
20
21
22
23
24
25
26
27
28
29
30
31
32
33
34
35
36

204
210
221
222
219
297
296
236
252
250
266
265
251
254
231
253
255
217
218
297
234
254
286
256
259
261
253
260
220
257
213

DRAWING MACHINE AND METHOD FOR DRAWING AN ELONGATED WORKPIECE

CROSS REFERENCE TO RELATED APPLICATIONS

Applicants claim priority under 35 U.S.C. §119 of German Application No. 10 2004 031 843.3 filed Jun. 30, 2004. Applicants also claim priority under 35 U.S.C. §365 of PCT/DE2005/001145 filed Jun. 28, 2005. The international application under PCT article 21(2) was not published in English.

The invention relates to a drawing machine for the drawing of a longitudinal workpiece with at least a sprocket chain carrying drawing tools of chain elements linked via chain links wherein the chain links on the one hand comprise the chain elements and on the other hand the connecting links linking the chain elements and wherein at least a drawing tool corresponds directly with a connecting link. Likewise the invention relates to a method for the drawing of a longitudinal workpiece by means of at least a sprocket chain carrying drawing tools of chain elements linked via chain links wherein the chain links on the one hand comprise the chain elements and on the other hand the connecting links linking the chain elements wherein drawing forces from a drawing tool are directly directed into at least a corresponding connecting link.

These types of devices and methods for the drawing of a longitudinal workpiece are known in many forms from the prior art. As an example DE 101 22 340 A1 discloses a chain drawing machine for the continuous drawing of drawing material, more preferably of bar or pipe-shaped drawing material wherein clamping jaws which clamp the drawing material during the drawing process are arranged on a tooth-type chain. Each tooth-type chain herein comprises link plates which extend in the circulating direction of the tooth-type chain and pin-type connecting elements arranged transversely to the circulating direction of the tooth-type chain by means of which link plates essentially arranged one after the other in circulating direction are linked with one another.

The clamping jaws are attached to the pin-type connecting elements. For attaching the clamping jaws to the tooth-type chain the clamping jaws have bores transversely to the circulating direction of the tooth-type chain into which the pin-type connecting elements are inserted so that each clamping jaw is directly attached to at least a pin-type connecting element. Indirectly, each clamping jaw is also in working connection per se with the remaining pin-type connecting elements by way of the tooth-type chain. As is evident in FIGS. 3 and 4 of DE 101 22 340 A1 the clamping jaw with the drawing chain shown there is directly in contact on both sides with the pin-type connecting elements so that with this arrangement each clamping jaw and each drawing tool is in direct contact with two connecting links. With the remaining connecting links a respective drawing tool is merely in contact by way of the chain, i.e. merely indirectly, i.e. by way of the connecting links, with which the respective drawing tool is in direct contact or by way of the chain link comprising these connecting links.

The tooth-type chain constructed in this way is driven by means of return sprockets having teeth, and which teeth in the usual manner alternately interact with the link plates of the tooth-type chains formed tooth-like.

From DE 198 57 781 a corresponding drawing machine is also known wherein with this drawing machine a block pitch chain, the blocks of which carry the drawing tools, is utilized. With this arrangement the blocks are centrally arranged on connecting pins to the outside of which the link plates are attached. In the center each of the blocks has a cavity which provides space for pressing-on rollers which are also arranged on the connecting pins. An entirely different drawing machine is disclosed by DD 148 593 B, where the pressing-on forces are not applied via a frame but vertically to the circulating plane of the chain by the chain itself in that each chain link carries a feather key element which creates clamping forces in an upstream chain link.

The present invention is based on the object of further developing known drawing machines or drawing methods so that with largely identical dimensioning of a drawing chain significantly better drawing performances or identical drawing performances with reduced dimensioning of the drawing chain are achieved.

The object of the invention is solved by a drawing machine for the drawing of a longitudinal workpiece with at least a sprocket chain carrying drawing tools of connected chain elements, wherein the chain links on the one hand comprise the chain elements and on the other hand the connecting links linking the chain elements and wherein at least a drawing tool directly corresponds to a connecting element and which is characterized in that the drawing tool is in direct contact with each connecting element (231, 416) with which the drawing tool is in direct contact via at least two connecting pins (286; 480, 481; 486, 487, 488), between which at least a connecting pin (287; 482, 483) of a second chain element is arranged.

More preferably exactly one connecting pin of the second chain element can be arranged between the at least two connecting pins. As a result a particularly even force distribution with the advantages explained below can be guaranteed.

The problem of the invention is also solved by a method for the drawing of a longitudinal workpiece by means of at least a sprocket chain carrying drawing tools of chain elements linked via chain links wherein the chain links on the one hand comprise the chain elements and on the other hand the connecting links linking the chain elements, wherein drawing forces are directly directed into at least a corresponding connecting element and the drawing forces from the drawing tool are directed into each of the connecting links corresponding with the drawing tool by way of at least two connecting points between which at least a connecting point of a chain element not directly connected with the drawing tool is arranged.

Through a drawing machine of this type and this method respectively an advantageous splitting of forces into several connecting points takes place in the interface area "drawing tool/connecting link", as a result of which the processing forces during the drawing of a workpiece are divided by the drawing tool into the connecting link of the sprocket chain.

Because of this, more preferably the connecting links can be formed smaller with identical drawing forces or higher drawing forces can be realized with identically developed connecting forces.

In an advantageous manner processing forces to be absorbed during drawing, more preferably shearing forces that occur in this connection, which directly act from the drawing tools onto the connecting links, are greatly reduced through the provision of at least two connecting pins between the drawing tool and a connecting link corresponding with the latter. Because of this, higher processing forces with identical component thickness and, accompanied by this, also higher processing speeds are achieved on the one hand. On the other hand, the assemblies of the present drawing machine are dimensioned smaller with constant performance. By providing the at least two connecting pins at least two, preferably more, connecting points are provided between the drawing tool and the connecting link corresponding with the latter in an advantageous manner through which a considerably better since more uniform flow of force is achieved between the drawing tool and the connecting link.

In terms of the present invention the term "sprocket chain" means any chain that essentially consists of chain elements linked via chain links.

As relatively intrinsically stiff assemblies each of the chain elements link the chain links which impart the chain its mobility. Here, several assemblies jointly can form a chain element or a large number of assemblies can be part of a chain link so that the term of chain elements describes assemblies abstractly arranged one behind the other interconnected by way of link joints and the term of chain links any type of linked connection between two relatively intrinsically stiff assemblies regardless of the number of additional assemblies involved in this. While a sprocket chain is therefore largely formed linearly and frequently self-contained it has degrees of freedom vertically to this linear formation direction at the level of the chain links which guarantee and also limit the mobility of the sprocket chain. Each chain element can preferably consist of several link plates and/or a block wherein in the present context components or assemblies of a chain element, the strength, preferably their width, do not vary above a factor "two" are called link plates. Accordingly a chain element is merely required to have one block for if two blocks could be found parallel in a chain element these would be link plates. Depending on the embodiment the term block chains is also used if only blocks are present, pitch chains if only link plates are present and block pitch chains if link plates are mixed with blocks.

A chain link therefore comprises on the one hand at least two chain elements or assemblies thereof to be connected so that these chain elements form at least a part of the chain link. On the other hand a chain link comprises at least a connecting link which inter-links the at least two chain elements to be joined together. The connecting link consequently realizes this connection with the degrees of freedom which are stipulated by the type of chain link.

Accordingly, connecting links join these individual chain elements by pairs. Here, the connecting links preferably extend largely transversely to the circulating direction of the sprocket chain and are frequently formed pin-type. In terms of the invention it is more preferably immaterial if a connecting element consists of a single component or of several components, i.e. of an assembly, as for instance, of individual connecting link elements of a connecting link.

It is understood that several assemblies of a chain element can be arranged parallel next to one another and connected through one or several connecting links with a further chain element or with the assemblies of a further chain element.

In the present context the thickness of a chain element or an assembly thereof is defined as extension of the chain element vertically to a connecting line between the two chain links of the chain element. If the two chain links are developed such that each provides one degree of freedom merely in a link plane similar to a knee joint and that these two link planes coincide, the width of a chain element or an assembly thereof in the present context is defined as the thickness of the chain element or of this assembly vertically to these link planes. In the case of a self contained chain which merely has the aforementioned chain links a plane will then result relative to which the entire chain is arranged in parallel or in which the entire chain is arranged. The width of the chain elements and the assembly respectively is then defined as the thickness of the chain links vertically to this last mentioned plane.

In addition to this, independent of the aforementioned solution, the object of the invention is solved by a drawing machine which has at least a sprocket chain comprising link plates and carrying drawing tools with which the sprocket chain has chain elements interconnected via chain links wherein the chain links each comprise connecting links each connecting to chain elements and the drawing tools are attached to the link plates. Here, forces act from the drawing tools via the link plates on the connecting links of the sprocket chain wherein each of the link plate ends assigned to the connecting links can accordingly be called connecting pins. Consequently the forces are introduced in the connecting link at at least two connecting points since the drawing tool is arranged on at least two interspaced link plates arranged in parallel with one another in order to guarantee a preferably evenly distributed force introduction from the drawing tool into the sprocket chain.

Accordingly, the object of the invention is also solved independent of the aforementioned solutions by a method where drawing forces required for drawing are provided by means of a sprocket chain at least comprising link plates and the drawing forces are introduced into the sprocket chain by the workpiece by way of the link plates.

The object of the invention is furthermore solved also independently of the aforementioned solutions by a drawing machine with at least a sprocket chain comprising blocks having chain elements interconnected by way of chain links wherein each of the chain links comprises two connecting links linking chain elements and each block of a chain element has at least two adjacently arranged interspaced connecting pins for each of its connecting links between which at least one connecting pin of an adjacent chain element is arranged.

Through the adjacently located and interspaced connecting pins or corresponding connecting points between the blocks and connecting links corresponding with the blocks, drawing forces are introduced multi-distributed in the connecting links as a result of which, also with a view of the sprocket chain comprising the blocks, the advantages mentioned above are achieved.

Independent of the aforementioned features this object is also solved by a drawing machine for the drawing of a longitudinal workpiece with at least a sprocket chain carrying drawing tools of chain elements connected via chain links wherein the chain links on the one hand comprise the chain elements and on the other hand the connecting links linking the chain elements, where at least one drawing tool is attached to a chain link, having at least a frictional grip facility for the frictional connection between the sprocket chain and the workpiece and pressing-on means for providing a pressing-on force required for the frictional connection provided by a frame wherein the pressing-on force acts directly on the chain link and which is characterized in that the drawing tool is in contact with each connecting link with which the drawing tool is in direct contact by way of at least two connecting pins.

Similarly the object is cumulatively and alternatively solved by a method for the drawing of a longitudinal workpiece by means of at least a sprocket chain of chain elements linked via chain links carrying drawing tools where the chain links on the one hand comprise the chain elements and the connecting links linking the chain elements on the other, the drawing forces from a drawing tool are directly directed into at least a corresponding connecting link, the workpiece is frictionally picked up by the sprocket chain and the pressing-on forces required for the frictional connection are applied by a frame and the pressing-on forces act directly on the chain link wherein the drawing forces from the drawing tool are introduced into each of the connecting links corresponding with the drawing tool by way of at least two connecting points.

In this connection the term "direct" means the fact that the pressing-on force which finally is applied to the workpiece by the chain is to be applied to the corresponding chain link carrying the drawing tool bypassing other assemblies of the chain, especially bypassing the connecting links. In this way the number of highly loaded assemblies is minimized so that the number of the extremely sturdily formed assemblies can be minimized.

Such an arrangement and such a method already differ fundamentally even by its type from an arrangement according to DE 198 57 781 A1 since there the pressing-on forces are transmitted via the connecting links into the chain and onto the drawing tools so that the connecting links are subjected to double loading and even for this reason have to be formed considerably stronger and bulkier than needs to be the case with the aforementioned arrangement or the aforementioned method. In addition, this arrangement and this method fundamentally differs from DE 148 593 B since the pressing-on forces there are applied by the chain itself.

The invention under consideration is therefore based on the knowledge that in an advantageous manner the drawing forces are introduced into the chain by the drawing tool which is attached to a chain of a drawing machine such that the chain links are not unnecessarily singularly loaded. As a consequence, the present invention differentiates itself more preferably from DE 101 22 340 A1, but also from other prior art wherein the force as a rule is applied to a connecting pin via a bore or an opening provided on a pin so that through the two edges of the openings of such pins or through the edges of the bores shearing points are conditional where very high shearing forces occur which have to be counteracted by selecting very strong pins. This is different with the present invention according to which the drawing forces are introduced into the connecting links of the chain links or into the chain by way of very many connecting points, link plates or connecting pins. Here the forces are distributed considerably more uniformly while the force distribution can be selected more preferably through the number of connecting points, link plates or connecting pins of a chain element.

In addition to this, the object of the invention independent of the aforementioned solutions is solved by a drawing machine having at least a sprocket chain comprising link plates, at least a frictional grip facility for the frictional connection between sprocket chain and workpiece and pressing-on means for applying a pressing-on force required for the frictional connection wherein at least two link plates of a chain element or two superimposing link plates of adjacent chain elements have pressing-on surfaces on their side facing away from the workpiece. Advantageously the pressing-on forces here can be applied by a frame of the drawing machine via the link plates of the sprocket chain. As a consequence, extremely even distribution of the corresponding pressing-on forces is obtained. In addition, no separate assemblies have to be provided for this purpose. This solution is more preferably advantageous in interaction with idlers as for instance disclosed in U.S. Pat. No. 3,945,547 and in EP 0 548 723. In contrast with this, the chain elements with this arrangement are compressed extremely evenly as a result of which wear can be minimized and the performance of the drawing machine increased.

The object of the invention is cumulatively and alternatively also solved by a drawing machine which for drawing a longitudinal workpiece has at least a sprocket chain comprising link plates and carrying drawing tools, where at least one link plate on its side facing the tool has a drawing tool rest. Through such a drawing tool rest further assemblies in this regard can be omitted. More preferably it is also possible to transmit possible pressing-on forces if required directly via the drawing tool rest of the link plates to the respective drawing tool, while uniform force distribution is made possible through the use of several link plates.

A particularly advantageous force transmission between drawing tools and a frame of a drawing machine and idlers of a drawing machine is obtained if on a drawing tool rest of the link plate of a chain element a drawing tool of an adjacent chain element rests while the drawing tool passes through a central drawing area. Insofar the pressing-on forces can be distributed over several chain elements or link plates arranged one after the other, as a result of which greater pressing-on forces can be applied in total.

The object of the invention is cumulatively and alternatively additionally solved by a drawing machine which has at least a pitch chain comprising link plates and the pitch chain has at least a frictional grip facility for the frictional connection between the pitch chain and the workpiece and pressing-on means for applying a pressing-on force required for the frictional connection and comprising the pressing-on means of the link plates of the pitch chain.

Here, the link plates of the present pitch chain like the connecting pins explained above act together with connecting links of the pitch chain so that the processing forces which occur during the drawing of the workpiece are introduced into the connecting links of the pitch chain corresponding with the link plates at at least two interspaced connecting points. As a result, the connecting links of the pitch chain more preferably are also exposed to lower shearing forces through which the advantages already described above are also achieved in connection with the pitch chain under consideration.

The use of link plates of a sprocket chain comprising link plates for the transmission of the pressing-on forces with a drawing machine allows developing the chain lighter with identical pressing-on forces especially compared with the solutions known from the prior art where the pressing-on forces are transmitted via blocks of a sprocket chain. As a result, centrifugal problems which occur with chains circulating at high speeds can be reduced for instance.

An embodiment version provides that a sprocket chain or a pitch chain is a tooth-type chain. As a result, the advantages of a pitch chain described above can be suitably utilized. Force transmission between the tooth-type chain and corresponding sprockets is also relatively good more so since a tooth-type chain can interact with standardized sprockets without problem.

The sprocket chain or the pitch chain can be employed particularly effectively in connection with the present drawing machine even independent of the remaining features of the present invention if the drawing machine has at least a sprocket at the circumference of which first rows arranged vertically to the circulating direction with first sprocket teeth and offset relative to this, second rows with second sprocket teeth are arranged vertically to the circumferential direction, wherein the first sprocket tooth rows are arranged axially offset relative to each other compared with the second row of sprocket teeth.

Through the sprocket rows of teeth arranged offset relative to each other the individual sprocket teeth of the first sprocket rows of teeth are also arranged offset relative to the sprocket teeth of the second sprocket rows of teeth.

In this way, a particularly large multiplicity of sprocket teeth is accommodated in a particularly small space on the circumference of the sprocket which for instance can alternately act on a sprocket chain for example. More preferably the teeth and their flanks can also be developed axially overlapping. As a result, particularly good and even transmission of force between the sprocket and the sprocket chain is created which has a corresponding effect on the drawing process which thus takes place more evenly as well. This very good transmission of force is due to the sprocket rows of teeth which are offset relative to one another and the concomitant particularly large number of points of action between the sprocket and the sprocket chain.

The term "circumference" largely describes an area of the lateral area of the sprocket on which the sprocket teeth are arranged.

The term "circulating direction" in terms of the invention describes the component-specific rotational direction which is predetermined for the sprocket when it drives or at least deflects a sprocket chain of the drawing machine. Consequently the circulating direction of the sprocket at least in the area of the drawing plane largely corresponds to the direction of movement of the sprocket chain of the drawing machine.

"Sprocket teeth" in this case means any driving means suitable for being attached to a sprocket such that they can be used to drive or deflect a sprocket chain.

The term "sprocket row of teeth" means rows of inter-spaced sprocket teeth running vertically to the circulating direction. Seen in circulating direction the sprocket rows of teeth are arranged with inter-spacing on the sprocket. Here, the sprocket rows of teeth cannot only be formed in the way of a straight-line toothed sprocket but for instance also in the way of a helically toothed sprocket through the sprocket teeth.

An embodiment version provides for a sprocket which is formed of several individual sprocket blades wherein first sprocket blades form first rows on first sprocket teeth of the sprocket as well as second sprocket blades form second rows on second sprocket teeth of the sprocket blade and vertically to the circulating direction of the sprocket the first sprocket rows of teeth are offset relative to the second sprocket rows of teeth.

With this alternative embodiment which is advantageous also regardless of an offset of sprocket rows of teeth, the sprocket does not consist of a single body but consists of a multiplicity of individual sprocket blades. Consequently the sprocket can be manufactured and assembled by means of punched or cut-out components if required and need not have to be manufactured of solid material for instance. In this regard, such a sprocket can be manufactured relatively economically.

Preferably the thickness of a sprocket blade is identical to the thickness of a sprocket tooth attached to the blade so that the present sprocket blade can be manufactured particularly easily in terms of construction. In order for the first sprocket blades to be able to form first sprocket rows of teeth and second sprocket blades second sprocket rows of teeth the first sprocket blades are preferably joined into a sprocket twisted on a rotation axis relative to one another relative to the second sprocket blades. Preferably sprocket blades adjoining one another are arranged twisted relative to one another as a result of which a particularly even force distribution can be guaranteed in running operation.

It is advantageous if the first sprocket blades and the second sprocket blades are identical. Consequently all sprocket blades of a sprocket can be formed and manufactured identically, but form the sprocket with offset sprocket teeth in a particularly easy manner due to the fact that the first sprocket blades and the second sprocket blades are arranged to form a sprocket twisted relative to each other. Owing to the multiplicity of identical components the sprocket can be manufactured of the sprocket blades particularly economically.

A preferred embodiment version provides for the first sprocket blades and the second sprocket blades being combined into a sprocket twisted relative to each other by an angle so that component free space is formed between the first sprocket row of teeth and the second sprocket row of teeth vertically to the circulating direction of the sprocket. As a result, an overlap of the chain elements engaging in the teeth is made possible as a result of which the force distribution in the chain is evened out.

The sprocket chain can be constructed relatively easily if first sprocket rows of teeth are arranged offset relative to second sprocket rows of teeth transverse to the circulating direction of a sprocket by the thickness of a sprocket tooth. In this way it is made possible to construct the sprocket chain of two types of chain elements each of them of link plates arranged in parallel relative to each other over the chain element width wherein each of the chain element types is arranged alternately along the chain. Each of the chain rows of teeth can then alternately interact with a chain element type.

The "thickness" of a sprocket tooth is generally predetermined through the maximum material thickness of the sprocket tooth vertically to the circulating direction which a sprocket tooth has vertically to the circulating direction of the chain sprocket. If a sprocket therefore consists of a multiplicity of sprocket blades the "thickness" of a sprocket tooth corresponds in an advantageous manner to the thickness of the sprocket blade.

It is advantageous if, seen in the circulating direction of a sprocket, between a front sprocket tooth arranged on the sprocket and a rear sprocket tooth arranged on the sprocket and in alignment with the former and/or between individual sprocket teeth of a sprocket blade an accommodation area for the chain element of the sprocket chain or for individual assemblies of the chain element is available. As a result, a link plate or another assembly of a chain element can be placed next to or between the sprocket teeth so that for instance the chain elements in a stretched part of the chain are able to form a surface that is continuous in circulating direction but interrupted through recesses arranged staggered by way of which pressing-on forces are applied.

The term "accommodation area" in terms of the present invention describes a space between a front sprocket tooth and a rear sprocket tooth in which a chain element of a sprocket chain completely or at least partly can be arranged as soon as the sprocket interacts with a sprocket chain.

Such an accommodation area is also advantageous on its own for a drawing machine regardless of the remaining features for being able to apply large drawing forces or pressing-on forces.

Between sprocket and sprocket chain, large forces can be transmitted especially if a chain having link plates is employed, cumulatively and alternatively to the aforementioned features, if in a chain element accommodation area of a sprocket the chain element of the sprocket chain is arranged such that a sprocket tooth of the sprocket of the drawing machine is exclusively in contact with recess-free areas of attack of the chain element or a corresponding link plate. In that the sprocket tooth is exclusively in contact with the recess-free areas of attack of the chain element or the link plate such recesses can be omitted. As a result, a respective chain element is imparted good intrinsic stiffness to accommodate the drawing forces on the sprocket tooth. In addition to this the recess-free area by omitting such types of recesses can be utilized for applying pressing-on forces.

The recess-free area of attack is preferably, seen in the circulating direction of the sprocket chain, arranged on a front and on a rear end of the chain element or the link plate.

In addition to this, it is advantageous cumulatively and alternatively especially with a sprocket chain having link plates if a sprocket tooth of a sprocket merely has working connections with a sprocket chain in areas of attack of the chain element of the sprocket chain which are arranged outside an intermediate area between two links of the chain element having connecting links. Through areas or surfaces of attach arranged in this way it is ensured that the sprocket tooth comes in contact merely with outer boundary surfaces of the chain element and not with recessed areas of a chain element which are situated in areas between links having two connecting links. As a result, the chain elements are directly merely compression loaded through the sprocket teeth which altogether leads to advantageous introduction of force. Accordingly, greater forces or, with identical forces, smaller assemblies can be employed.

In this connection it is advantageous if the chain elements of a sprocket chain or its link plates or blocks have a straight or flat sliding area on their areas facing the sprockets. Through the straight or flat sliding area the sprocket chain is able to have a large sliding or support surface to a frame or a sliding and support zone of the drawing machine or to idlers. As a result, forces which act on the sprocket chain by way of the drawing tools can be directed more effectively from the sprocket chain into the drawing machine.

A preferably large straight or flat sliding area is more preferably obtained if the chain elements have only recess-free areas of attack since these are arranged only at ends of the chain elements and not between links of a single chain element and the remaining areas facing the sprockets can largely be utilized as straight or flat sliding area.

It is advantageous in addition if the straight or flat sliding area at least in a main drawing area of the machine corresponds to a frame, a sliding and support zone of the drawing machine or with idlers.

The main drawing area here forms at least a middle drawing path in which drawing tools are in contact with the workpiece.

The features in connection with the straight or flat sliding area are suitably advantageous even without the remaining features of the invention.

Compared with the sprocket the sprocket chain receives particularly stable and consequently advantageous guidance if a sprocket tooth of a sprocket is flanked at least in the working area with the sprocket chain of the drawing machine by two chain elements of the sprocket chain each.

Further advantages, objectives and characteristics of the present invention are described by means of the following explanation of the attached drawing in which drawing machines and their essential components are shown as an example.

It shows

Figure 2:
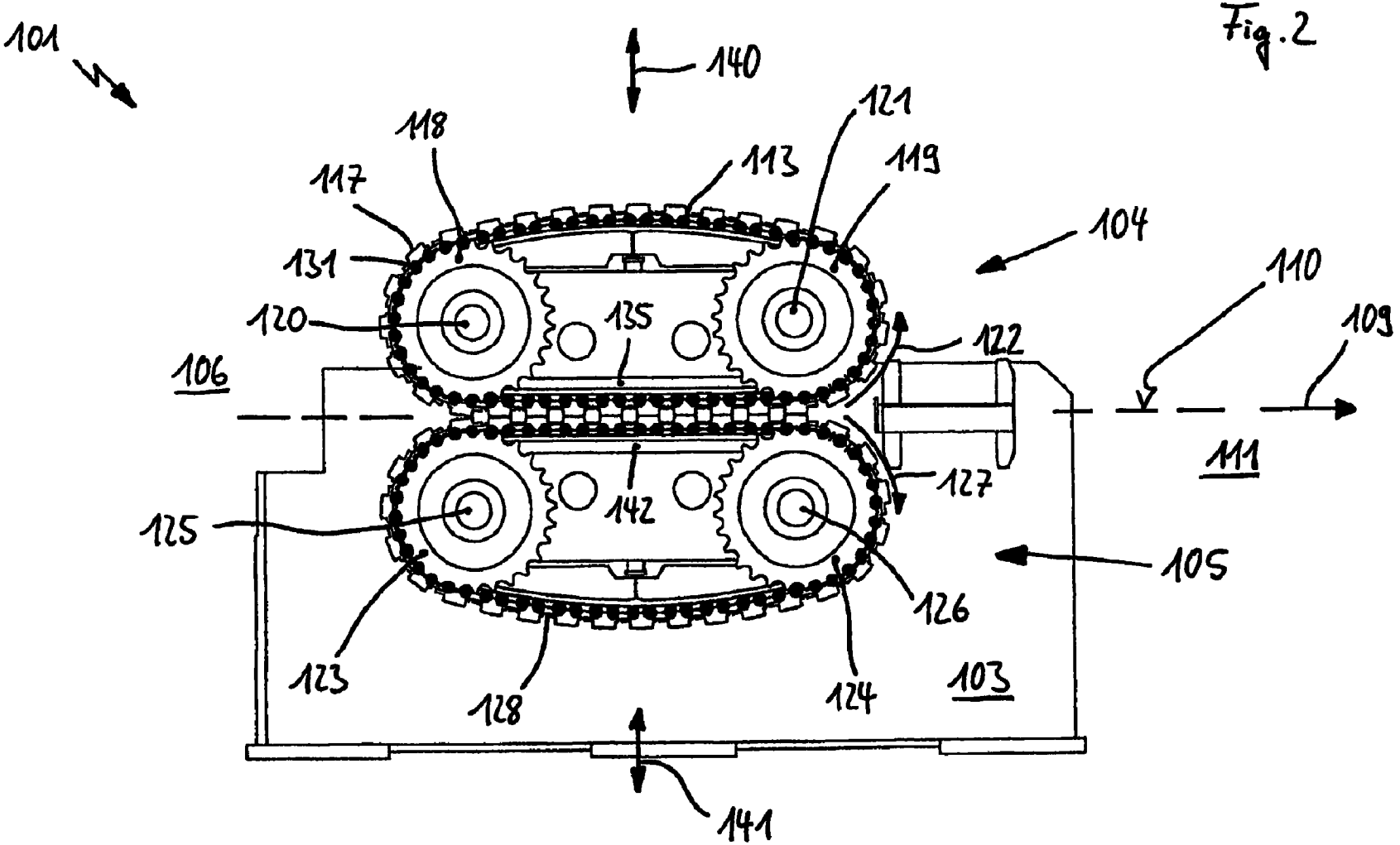
Figure 3:
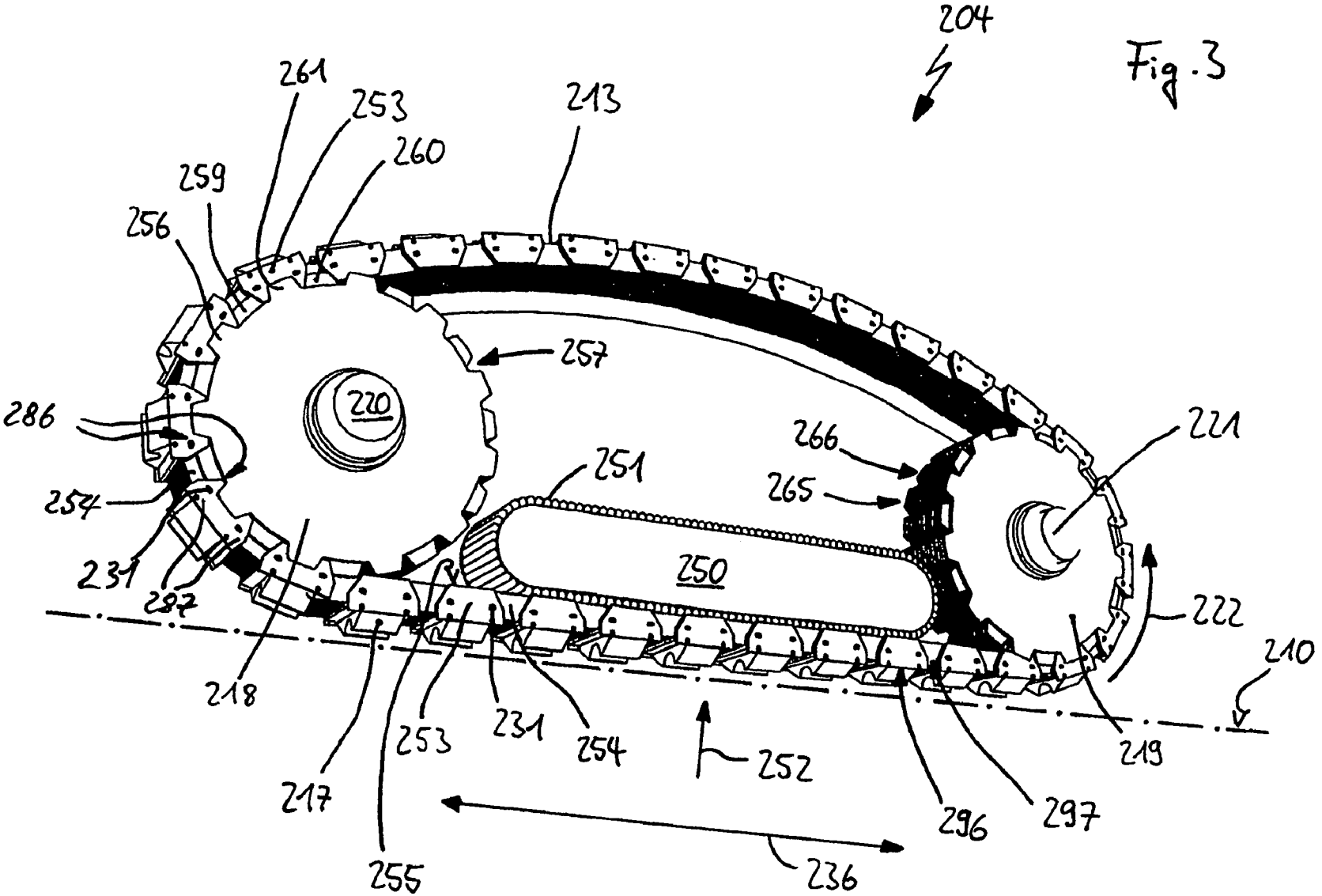
Figure 4:
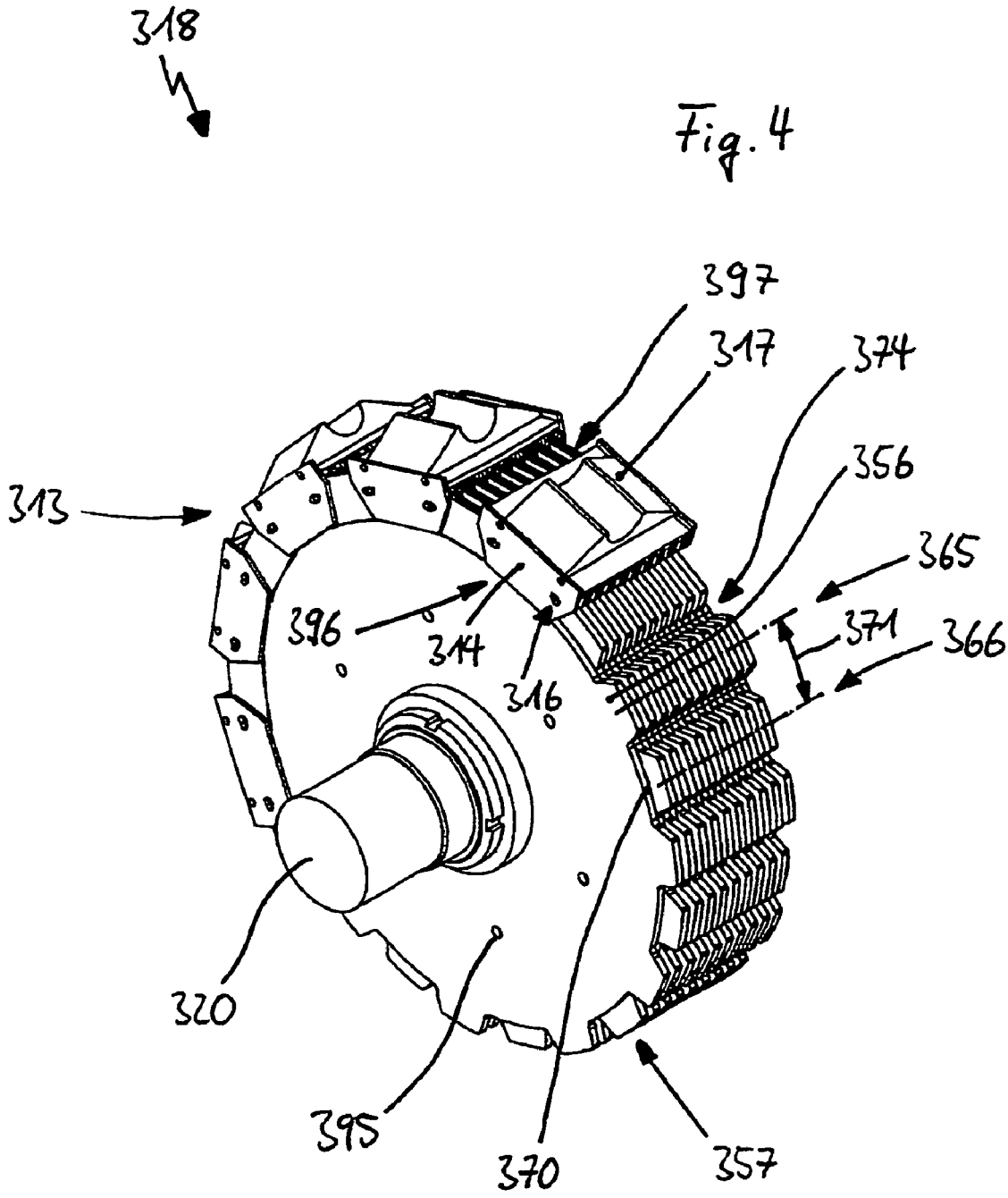
Figure 5:
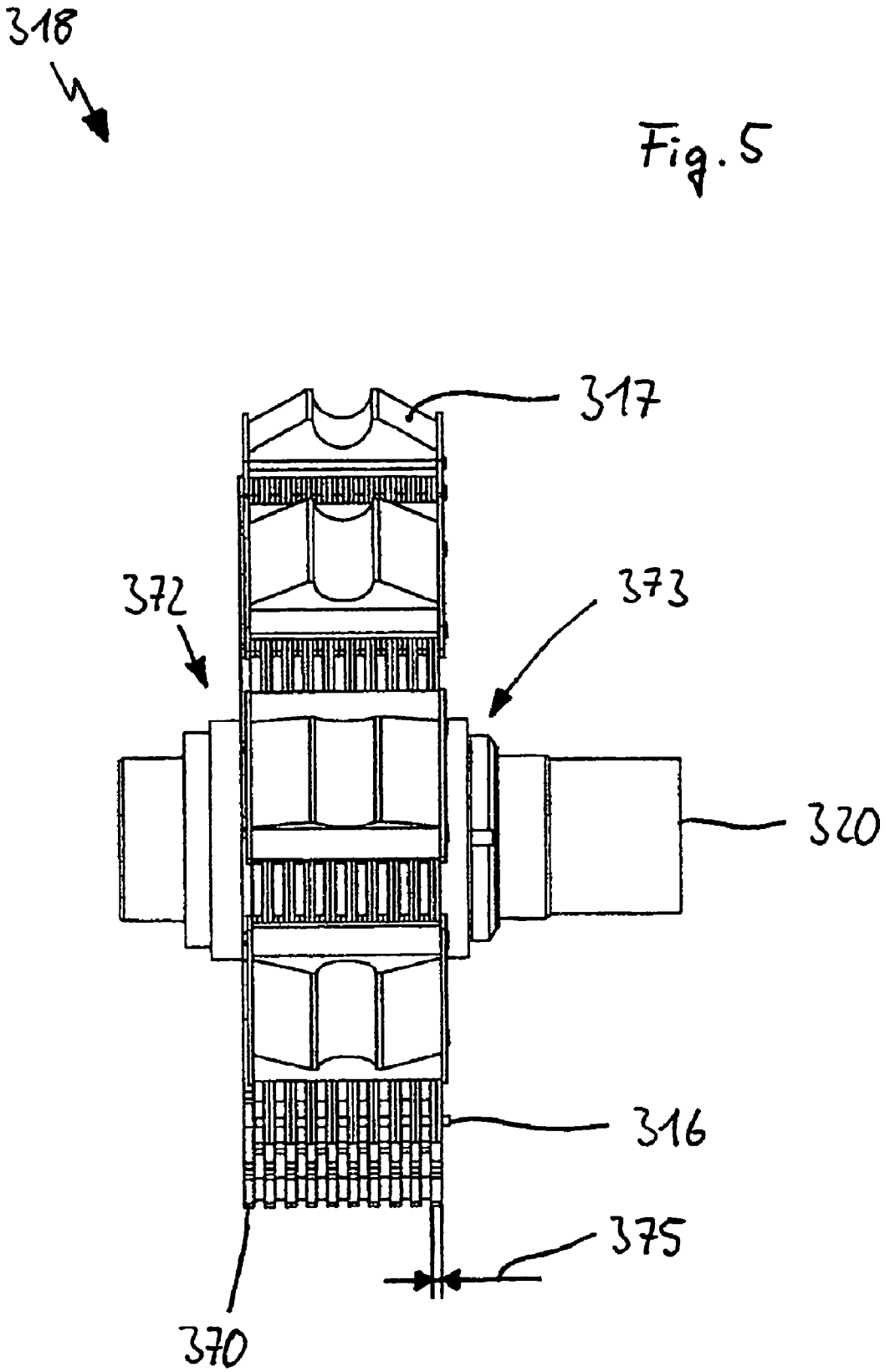
Figure 6:
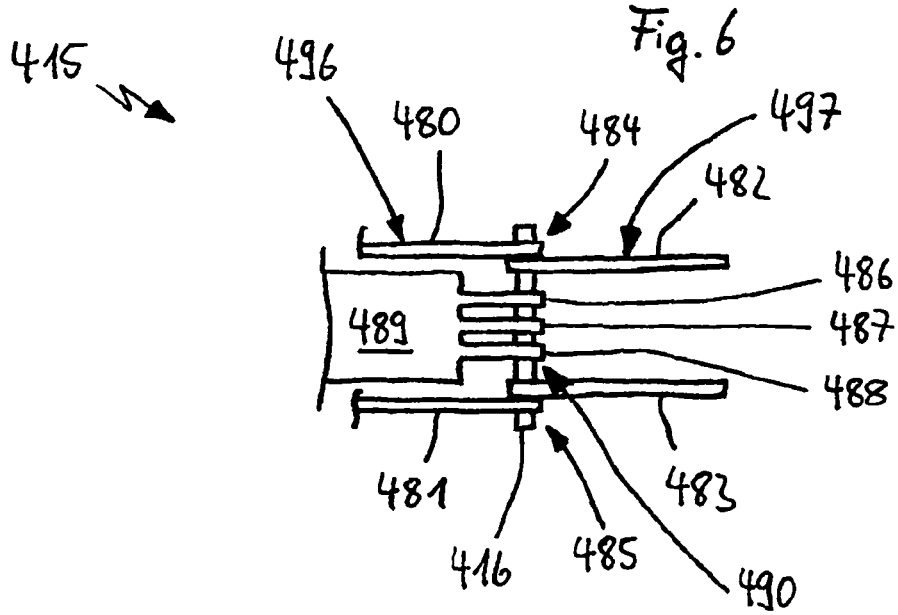
Figure 7:
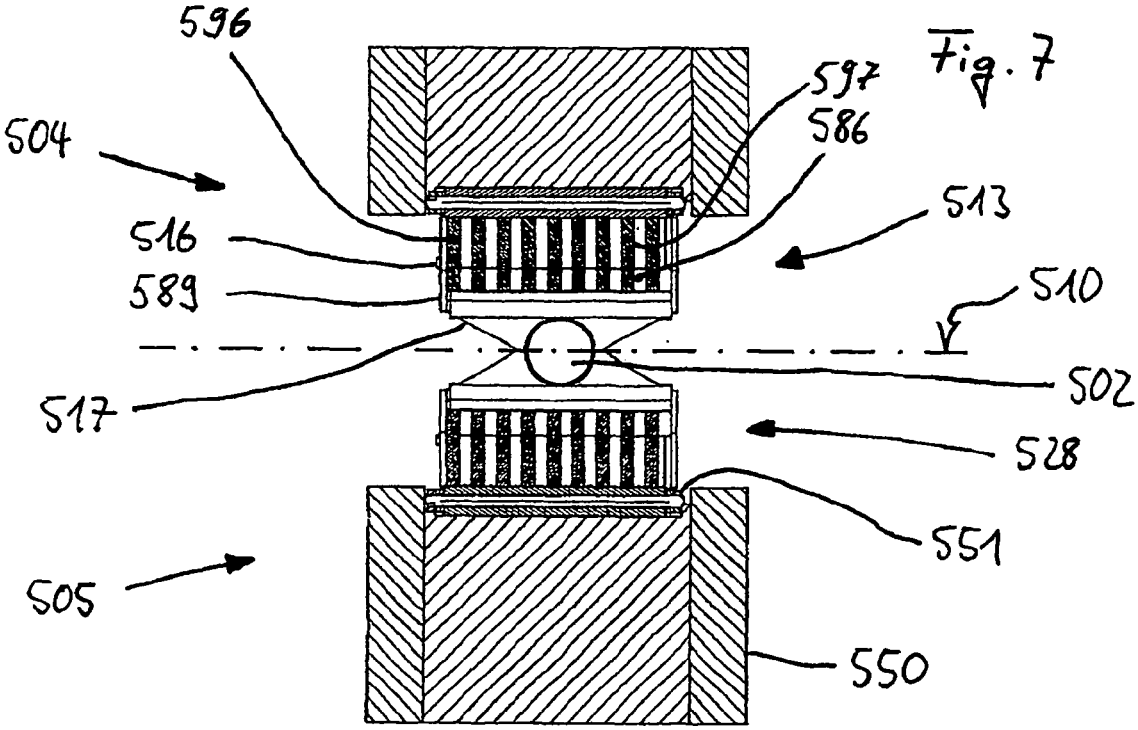

FIG. 1 schematically a lateral view of a drawing machine with a flatter,

FIG. 2 schematically a lateral view of a further drawing machine,

FIG. 3 schematically a perspective view of a first chain pull,

FIG. 4 schematically a perspective view of a sprocket with a sprocket chain, FIG. 5 schematically a top view of a sprocket with a sprocket chain, FIG. 6 schematically a view of a link connection of a sprocket chain and FIG. 7 schematically a cross section through a drawing plane of a drawing machine.

The drawing machine 1 shown in FIG. 1 for the drawing of a longitudinal workpiece 2 has a frame 3 in which a first chain pull 4 and a second chain pull 5 are arranged. The frame 3 of the drawing machine 1 in its inlet area 6 has a flatter holder 7 attached to which is a flatter 8. The longitudinal workpiece 2 is drawn in the conveying direction 9 and in a drawing plane 10 (vertically to the drawing plane of the FIG. 1) through the flatter 8 and correspondingly transported from the inlet area 6 through the drawing machine 1 to a discharge area 11.

To draw the longitudinal workpiece 2 through the flatter 8 a suitable drawing force 12 is transmitted to the longitudinal workpiece 2. With the drawing machine 1 this is done by the first chain pull 4 and by the second chain pull 5.

To this end, the first chain pull 4 of the drawing machine 1 has a first sprocket chain 13. The first sprocket chain 13 largely consists of chain elements 14 which are inter-linked via chain links 15 by means of connecting links 16. In order to transmit the processing forces required for the drawing of the longitudinal workpiece 2 from the first sprocket chain 13 preferably homogenously and to a large area of the longitudinal workpiece 2, the first sprocket chain has 13 drawing tools 17 by means of which large area and homogenous force transmission between the longitudinal workpiece 2 and the first chain pull 4 is guaranteed.

The first sprocket chain 13 is deflected and/or driven by means of a front sprocket 18 and a rear sprocket 19. Both the front sprocket 18 and the rear sprocket 19 each turn around a rotation axis 20 or around a rotation axis 21. To move the longitudinal workpiece 2 in drawing direction 9 both the front sprocket 18 and the rear sprocket 19 rotate with a circulating direction 22 (only drawn as an example on the rear sprocket 19).

The second chain pull 5 of the drawing machine 1 in this exemplary embodiment has an identical construction to the first chain pull 4. The second chain pull 5 also has a front sprocket 23 and a rear sprocket 24 wherein the front sprocket 23 rotates around a rotation axis 25 and the rear sprocket 24 around a rotation axis 26. Both the front sprocket 23 and the rear sprocket 24 rotate in circulating direction 27 (only drawn as an example on the rear sprocket 24) during the transport of the longitudinal workpiece 2. On the second chain pull 5, a second sprocket chain 28 of the drawing machine 1 is driven by means of the front sprocket 23 and the rear sprocket 24. The second sprocket chain 28 also has chain elements 29 which are interlinked in chain links 30 by means of connecting links 31.

The presentation of drawing tools 17 was omitted for the sake of clarity with regard to the second sprocket chain 28. However it is understood that the second sprocket chain 28 should also have drawing tools 17 at its disposal to be able to evenly transmit processing forces between the second sprocket chain 28 and the longitudinal workpiece 2.

In order for the sprockets 18, 19, 23 and 24 of the drawing machine to be able to transmit drive forces to the first sprocket chain 13 and the second sprocket chain 28, each sprocket 18, 19, 23 and 24 of the drawing machine 1 has sprocket teeth 33 on each of its sprocket circumferences. For the sake of clarity, the sprocket circumference 32 and the sprocket teeth 33 are merely numbered on the front sprocket 23.

The chain elements 14 of the first sprocket chain 13 and the chain elements 29 of the second sprocket chain 28 with this drawing machine 1 are formed as link plates (explained on the example of FIGS. 3 to 7) to which the respective drawing tools 17 are attached.

By means of the drawing tools 17, which here are arranged on the link plates or on the chain elements 14, 29 of the sprocket chain 13 or 28 a frictional connection is established between the sprocket chains 13 and 28 and the longitudinal workpiece 2. In the process, the assemblies of the sprocket chain 13 and 28 make available pressing-on means for creating a pressing-on force necessary for the frictional connection wherein at least two link plates of a chain element 14, 29 or two overlapping link plates of adjacent chain elements 14, 29 provide pressing-on surfaces 34 at their side facing away from the longitudinal workpiece 2. By way of these pressing-on surfaces 34 the chain elements 14, 29 or the link plates of the chain elements 14, 29 support themselves on sliding and support zones 35 of the drawing machine frame 3 so that processing forces required for applying the drawing forces 12 can be transmitted via a particularly large area between the longitudinal workpiece 2 and the drawing machine frame 3.

The sliding and support zones 35, on which the pressing-on surfaces 34 of the individual chain elements 14, 29 of the sprocket chains 13 and 28 support themselves, largely extend in a main drawing area 36 of the drawing machine 1 both on the first chain pull 4 and on the second chain pull 5 and can be realized per se by means of measures known from the prior art. The main drawing area 36 with this exemplary embodiment is located between the front sprocket 18 and the rear sprocket 19 or between the front sprocket 23 and the rear sprocket 24. Not shown are means of this drawing machine for setting the distance between the two chain pulls 4 and 5 in order to take into account different tool diameters. Also not shown are means of this drawing machine for applying the pressing-on pressure between the sliding and support zones 35 and the frame 3. For these purposes it is possible for instance to make use of hydraulic arrangements or levers, eccentric pins or wedges. It is understood that through such measures both spacing adjustment as well as pressing-on forces can be realized.

The drawing machine 101 shown in FIG. 2 has a drawing machine frame 103 on which a first chain pull 104 and a second chain pull 105 are arranged. The first chain pull 104 is re-locatable relative to a drawing plane 110 vertically in the drawing machine 101 according to the double arrow direction 140. The second chain pull 105 is correspondingly relocatable vertically relative to the drawing plane 110 according to the double arrow directions (141). In this way the drawing machine can be adapted to various material thicknesses and a required pressing-on force applied. The drawing plane marked with the reference number 110 here extends vertically into the paper plane or from the paper plane.

By means of the two chain pulls 104 and 105 a drawing material (not explicitly shown here) is transported from an inlet area 106 to a discharge area 111 through the drawing machine 101.

For transporting the drawing material the first chain pull 104 has a first sprocket chain 113 which is driven with a front sprocket 118 and a rear sprocket 119 and circulates in the first chain pull 104. Here, the front sprocket 118 rotates around a rotation axis 120 and the rear sprocket 119 around a rotation axis 121.

In order for a particularly favorable frictional connection to be established between the first sprocket chain 113 and the drawing material, the first sprocket chain 113 has drawing tools 117 which are exactly matched to the drawing material to be transported. The drawing tools 117 are arranged directly on connecting links 131 of the first sprocket chain 113 which run vertically to a circulating direction 127, which additionally join link plates of a pitch chain not shown in closer detail. In this exemplary embodiment each drawing tool 117 is arranged on two such connecting links 131. Forces, which in the drawing plane 110 act on the first sprocket chain, are absorbed by sliding and support zones 135 of the drawing machine 101.

The construction of the second chain pull 105 corresponds to the construction of the first chain pull 104. The second chain pull 105 also comprises a front sprocket 123 and a rear sprocket 124 wherein the front sprocket 123 is rotatably mounted in a rotation axis 125 while the rear sprocket 124 is rotatably mounted in a rotation axis 126. By means of the two sprockets 123 and 124 a second sprocket 128 is driven which circulates on the second chain pull 105. The drawing tool 117 of the second sprocket chain 128 interacts in the area of the drawing plane 110 firstly with the drawing material and secondly with drawing tools 117 of the first sprocket chain 113 of the first chain pull 104. In order to be able to direct forces, which more preferably act on the second sprocket chain 128 in the area of the drawing plane 110 into the frame 103 of the drawing machine 101 the second chain pull 105 also comprises sliding and support zones 142.

The first chain pull 204 of an otherwise of a drawing machine otherwise largely corresponding with the arrangements according to FIGS. 1 and 2 shown in FIG. 3 largely comprises a front sprocket 218 and a rear sprocket 219 with which a sprocket chain 213 is driven.

In the area of a drawing plane 210 this first chain pull 204 has an idler facility 250 on the idlers 251 of which the sprocket chain 213 is supported, especially when, starting from the drawing plane 210, pressing-on forces 252 act on the sprocket chain 213. Thus, here, a main drawing area 236 of the drawing machine extends largely in the area of the idler facility 250. The pressing-on forces 252 are created when between a drawing material (not shown here) and the sprocket chain 213 a frictional connection is established by means of the drawing tools 217 and, by way of arrangements known per se, a pressing-on force is applied onto the sprocket chain 213 from a machine frame (similar to the frames 3 and 103 according to FIGS. 1 and 2) by way of the idlers.

In this exemplary embodiment each drawing tool 217 is attached to link plates 253 (only exemplarily numbered here) or to chain elements 296 of the sprocket chain 213 of these link plates 253 and link plates arranged in parallel to this. The chain elements 296 are interlinked by means of connecting links 231 and linked with adjacent chain elements 297, which are also formed of link plates. For instance the link plate 253 is an outer link plate of the sprocket chain 213 which, by way of the connecting link 231, is at least linked with an inner link plate 254 of the chain element 297. The outer link plates 253 of the chain elements 296 are additionally formed slightly higher than the remaining link plates of this chain element 296 on the workpiece side so that the tools can be laterally secured as a result.

On the link plates 253, 254 it is possible as exemplarily indicated in FIG. 3 to define connecting pins 286, 287 as the areas which are arranged in the vicinity of the connecting link 231 and forming the link with the latter.

A peculiarity of the present link plates 253, 254 must be seen in that these are formed flat on the sides 255 facing the sprockets 218, 219 so that they make large area contact with the idlers 251 of the idler facility 250 with the side 255 facing the sprockets 218, 219. Because of the large contact areas between the idlers and the side 255 formed flat the pressing-on forces 252 are particularly favorably transmitted from the sprocket chain 213 to the idler facility 250.

Moreover, the link plates 253 interact with sprocket teeth 256 of the sprockets 218 and 219 such that the link plates 253 engage in accommodation areas 257 of the sprockets 218, 219.

This mechanism is explained as an example with regard to the front sprocket 218. In this case for instance an outer link plate 258 of the sprocket chain 213 engages in one of the accommodation areas 257 of the sprocket 218. The accommodation area 257, in which the outer link plate 258 during contact with the sprocket 218 is arranged, is limited on the one hand by a front sprocket tooth 259 and a rear sprocket tooth 260 of the sprocket 218. Thus, the outer link plate 258 is positively connected with the sprocket 218 so that drive forces from the sprocket 218 can be advantageously transmitted to the sprocket chain 213. In order to guide the outer link plate 253 laterally stable in the accommodation area 257, i.e. in the area of attack of the sprocket 218, the outer link plate 253 on the one hand is additionally flanked by an outer sprocket 261 of the sprocket 218 and, on the other hand, additionally by an inner sprocket tooth (not identified here) of the sprocket 218.

Thus, the outer link plate 253 receives extremely stable guidance in the area of the front sprocket 218 so that even particularly strong acting forces cannot bring about that the outer link plate 254 breaks out from the accommodation area 257 of the front sprocket 218. The front sprocket 218 is rotatably mounted in a rotation axis 220. The same obviously applies also to all other link plates and teeth of the pitch chain 213.

The rear sprocket 219 is identically constructed to the front sprocket 218 and is rotatably mounted in a rotation axis 221.

In the presentation according to FIG. 3 first sprocket rows of teeth 265 and second sprocket rows of teeth 266 are particularly easily identifiable on the rear sprocket 219, wherein both the first sprocket rows of teeth 265 and the second sprocket rows of teeth 266 each have interspaced sprocket teeth 256. The first sprocket rows of teeth 265 and the second sprocket rows of teeth 266 extend transverse to a circulating direction 222 of the sprockets 218 and 219.

The sprocket rows of teeth 265, 266 of the sprockets 218 and 219 are largely aligned with the rotation axis 220 and with rotation axis 221 respectively depending on the sprocket 218 or 219 to which the sprocket rows of teeth 265 and 266 belong. The sprocket teeth 256 of the first sprocket row of teeth 265 in this exemplary embodiment are arranged offset to one another relative to sprocket teeth 256 of the second sprocket row of teeth 266, as is immediately visible.

The sprocket 318 illustrated in FIG. 4 and FIG. 5 in this exemplary embodiment is formed of 19 individual sprocket blades 370 (only numbered exemplarily here), while the sprockets described above are conventionally formed as solid gears. All sprocket blades 370 used here are identical and together attached on a rotation axis 320 such that through the multiplicity of the sprocket blades 370 first sprocket rows of teeth 365 and second sprocket rows of teeth 366 of the gear 318 are formed. The individual sprocket blades 370 are clamped rotationally secure relative to one another and on the other hand rotationally secure relative to the rotation axis 320 by means of first clamping means 372 and second clamping means 373 as well as by means of locking pins 395. Here, first sprocket blades and second sprocket blades are combined twisted by an angle relative to each other into the sprocket 318 such that a component free space 374 is created between the first sprocket rows of teeth 365 and the second sprocket rows of teeth transverse to the circulating direction of the sprocket 318 and, for instance, the first sprocket rows of teeth 365 each are interspaced relative to one another by an arc segment 371.

The individual sprocket teeth 356 of the sprocket rows of teeth 365 and 366 each are interspaced by the amount of the thickness 375 of a sprocket tooth 356 and here correspondingly also of one of the sprocket blades 370. The sprocket blades 370 here have a thickness which is identical with the thickness 375 of the sprocket teeth 356. The sprocket teeth 356 of the first sprocket row of teeth 365 and the sprocket 356 of the second sprocket row of teeth 366 are arranged offset relative to one another.

Accordingly, between two sprocket teeth 356 of a sprocket blade 370 an accommodation area 357 is provided for chain elements 314 (only numbered exemplarily here) of a sprocket chain 313. On every total of 10 adjacently arranged link plates 314 (exemplarily numbered) of the sprocket chain 313, each of which form a chain element 396, a drawing tool 317 is attached. Each of the 10 link plates 314 by itself corresponds to an accommodation area 357 provided for this purpose each of which are formed between sprocket teeth 356 of two adjacent first sprocket rows of teeth 365.The sprocket teeth 356 of the second sprocket rows of teeth 366 take over largely stabilizing functions the link plates of a further chain element 397, each of which engages in an accommodation area 357 between two sprocket teeth 356 of two first sprocket rows of teeth 365. Through this supporting measure the sprocket chain 313 the sprocket chain is particularly well guided relative to the sprocket 318.

All chain elements 396, 397 of the sprocket chain 313 are interlinked with their adjacent chain elements 397, 396 by way of connecting links 316.

The chain link 415 shown in FIG. 6 consists of a first chain element 496 which comprises a first left link plate 480, a block 489 and a first right link plate 481, a second chain element 497, which comprises a second left link plate 482 and a second right link plate 483 and a connecting link 416. The chain is then continued mirror-image style accordingly. It is understood that in an alternative embodiment instead of a separate connecting link connecting elements also designed as one piece with the respective chain elements, such as link shells, sliding pins or similar can be employed. Here, a first assembly "first left chain element 480, second left chain element 482 and connecting link 416" forms a left link area 484 while a further assembly "first right chain element 481, second right chain element 483 and connecting link 416" forms a right link area 485 of the chain link 416.

In this exemplary embodiment the first chain element 496 merely comprises the block 489 which serves as tool accommodation and to which the connecting link 416 is attached by means of a first connecting pin 486, a second connecting pin 487 and a third connecting pin 488. By way of the connecting pins 486, 487 and 488 drawing forces are introduced at three interspaced connecting points 490 (only drawn exemplarily here) directly into the connecting link 416 so that the drawing forces in total are transmitted onto the connecting link 416 and into the chain more homogenously. As a result, more favorable loading of the connecting link 416 is achieved. More preferably, shearing forces that occur at the connecting points 490 are distributed in accordance with the number of connecting points 490 and more agreeably introduced in the connecting link 416.

As a result, more preferably the diameters of the connecting link and/or the forces occurring in the link can be reduced considerably.

It is understood that depending on the concrete development the tool accommodation 489 need not necessarily have to be linked with two chain links or with two connecting links. If this is not the case but the tool accommodation is merely attached to a chain link or connecting link 416 the forces present in the chain are not directed via the tool accommodation. Merely the drawing forces which individually occur on a tool are then introduced into the corresponding link 416 and consequently into the chain by way of the respective tool accommodation 489. In this case the tool accommodation 489 is not part of the chain per se so that with the arrangement according to FIG. 6 it is a pitch chain and not a block-pitch chain. With such an arrangement it is then advantageous for more even force distribution even independent of the remaining features of the present invention that the forces are applied to the connecting link 416 by way of several connecting pins 486, 487, 488.

As for the rest, as immediately evident in FIG. 6, pins can be defined at the ends of the link plates 480, 481, 482, 483 as has already been explained in FIG. 4 by means of the exemplary embodiment shown there. The link areas 484, 485 described above are more preferably suitable for this purpose. Moreover, the tools with this embodiment can also be exclusively attached to the link plates 480, 481, 482, 483 and, additionally, to the link plates 480, 481, 482, 483.Likewise it is conceivable with the embodiment according to FIG. 6 to arrange link plates similar to the link plates 482, 483 or corresponding connection pins between the connecting pins 486 and 487 and 487 and 488.

The first chain pull 504 shown in FIG. 7 in cross section vertically to the drawing plane 510 and to the drawing direction and second chain pull 505 each has a idler carrier 550 (only numbered exemplarily with regard to the second chain pull 505 here). The idler carrier 550 carries idlers 551 on which a first sprocket chain 513 and a second sprocket chain 528 respectively support themselves. Such an arrangement can be employed especially in interaction with the arrangement shown in FIG. 3.

The first chain pull 504 and the second chain pull 505 in this exemplary embodiment are formed identically. For the sake of clarity, individual identical components and identical assemblies are merely numbered exemplarily here.

The first sprocket chain 513 consists of chain elements 596 which are linked with chain elements 597 by means of connecting links 516. A drawing tool 517 is connected with the chain elements by way of a dovetail connection 586 and secured by means of lateral raised steps 589 of the outer link plates of the chain elements 596. As immediately evident, tool attachment can be realized particularly easily as a result.

By means of the first sprocket chain 513 and an identical second sprocket chain 528 a longitudinal workpiece 502 of the drawing plane 510 is transported. In the present case the transport direction is directed into the paper plane.

As immediately evident, the chain elements 596 and 597 each have flat surfaces on the tool side which is interrupted in individual areas. On these surfaces the tools can support themselves favorably so that the pressing-on forces are distributed extremely uniformly.

The same applies to the side facing away from the tool 502 through which the idlers 551 are able to roll very evenly on the chain elements 596 and 597.

As more preferably evident by means of FIG. 4 the tools 217, 317, 517 can be formed shorter than the chain elements 596 in the circulation direction of the chains. On the other hand it is conceivable to develop the tools exactly as long or longer than the chain elements 596. With such a development the tools can then rest both on the chain elements 596 and on the chain elements 597 as is evident from FIG. 7.

Alternatively, tools can be directly attached or provided also on the chain elements 597. Moreover it is also conceivable to form the tools out of one piece with the chain elements or out of one piece with individual assemblies of the chain elements.

List of Reference Numbers:

| | |
|---|---|
| 1; 101 | Drawing machine |
| 2; 502 | Longitudinal workpiece |
| 3; 103 | Drawing machine frame |
| 4; 104; 204 | First chain pull |
| 5; 105 | Second chain pull |
| 6; 106 | Inlet area |
| 7 | Holder |
| 8 | Flatter |
| 9; 109 | Drawing direction |
| 10; 110; 210; 510 | Drawing plane |
| 11; 111 | Discharge area |
| 12 | Drawing force |
| 13; 113; 213; 313; 513 | First sprocket chain |
| 14; 314 | Chain elements |
| 15 | Chain links |
| 16; 316; 416; 516 | Connecting links |
| 17; 117; 217; 317; 517 | Drawing tools |
| 18; 118; 218; 318 | Front sprocket |
| 19; 119; 219 | Rear sprocket |
| 20; 120; 220; 320 | Front rotation axis |
| 21; 121; 221 | Rear rotation axis |
| 22; 122; 222 | Circulating direction |
| 23; 123 | Front sprocket |
| 24; 124 | Rear sprocket |
| 25; 125 | Front rotation axis |
| 26; 126 | Rear rotation axis |
| 27; 127 | Circulating direction |
| 28; 128; 528 | Second sprocket chain |
| 29 | Chain elements |
| 30 | Chain links |
| 31; 131; 231 | Connecting links |
| 32 | Sprocket circumference |
| 33 | Sprocket teeth |
| 34 | Pressing-on surfaces |
| 35; 135 | Sliding and support zone |
| 36; 236 | Main drawing area |
| 140 | Double arrow direction |
| 141 | Double arrow direction |
| 142 | Sliding and support zone |
| 250; 550 | Idler facility |
| 251; 551 | Idlers |
| 252 | Pressing-on forces |
| 253 | Link plates |
| 254 | Inner link plates |
| 255 | Side facing the sprockets |
| 256 | Sprocket teeth |
| 257; 357 | Accommodation area |
| 258 | Outer link plate |
| 259 | Front sprocket tooth |
| 260 | Rear sprocket tooth |
| 261 | Outer sprocket tooth |
| 265 | First sprocket rows of teeth |
| 266 | Second sprocket rows of teeth |
| 286 | First connecting pin |
| 287 | Second connecting pin |
| 296 | Chain element |
| 297 | Chain element |
| 318 | Sprocket |
| 370 | Sprocket blades |
| 371 | Section |
| 372 | First clamping means |
| 373 | Second clamping means |
| 374 | Component free space |
| 375 | Thickness of a sprocket tooth |
| 395 | Locking pin |
| 396 | Chain element |
| 397 | Chain element |
| 480 | A first left link plate |
| 481 | A first right link plate |
| 482 | A second left link plate |
| 483 | A second right link plate |
| 484 | Left link area |
| 485 | Right link area |
| 486 | First connecting pin |

-continued

| | |
|---|---|
| 487 | Second connecting pin |
| 488 | Third connecting pin |
| 489 | Drawing tool accommodation |
| 490 | Connecting points |
| 496; 596 | Chain element |
| 497; 597 | Chain element |
| 586 | Dovetail connection |
| 589 | Lateral raised step of the chain elements 596 |

The invention claimed is:

1. A drawing machine for drawing a longitudinal workpiece, the drawing machine comprising:

(a) a sprocket chain comprising a plurality of chain elements, a plurality of connecting links, a plurality of first connecting pins, a plurality of second connecting pins, and a plurality of third connecting pins, each of the connecting pins being associated with a respective chain element; and (b) a plurality of drawing tools;

wherein the sprocket chain carries the plurality of drawing tools;

wherein a first chain element of the plurality of chain elements is linked to a second chain element of the plurality of chain elements via a first connecting link of the plurality of connecting links;

wherein each drawing tool of the plurality of drawing tools directly corresponds to at least one respective connecting link of the plurality of connecting links;

wherein each drawing tool of the plurality of drawing tools is in direct contact with the at least one respective connecting link of the plurality of connecting links by way of at least a respective first connecting pin of the plurality of first connecting pins and a respective second connecting pin of the plurality of second connecting pins;

wherein each drawing tool corresponds to a chain element of the plurality of chain elements; and wherein a third connecting pin of the plurality of third connecting pins associated with the second chain element contacts the first connecting link of the plurality of connecting links between a first connecting pin and a second connecting pin.

2. The drawing machine according to claim 1, wherein the third connecting pin of the second chain element is the only connecting pin arranged on the at least one connecting link between the first connecting pin and the second connecting pin.

3. The drawing machine according to claim 1, wherein each chain element of the plurality of chain elements comprises at least one link plate;

wherein each drawing tool of the plurality of drawing tools is at least a frictional grip facility for frictional connection between the sprocket chain and the longitudinal workpiece;

wherein the drawing machine further comprises pressing-on means for applying a pressing-on force required for a frame frictional connection; and wherein each chain element of the plurality of chain elements has a pressing-on surface facing away from the longitudinal workpiece during operation of the drawing machine.

4. The drawing machine according to claim 1, wherein the sprocket chain further comprises a plurality of link plates;

wherein the sprocket chain further comprises a first drawing tool support located to a side of a first link plate of the plurality of link plates; and wherein the first drawing tool support faces the longitudinal workpiece during operation of the drawing machine.

5. The drawing machine according to claim 4, wherein the sprocket chain further comprises a second drawing tool support located to a side of a second link plate of the plurality of link plates;

wherein the first link plate of the plurality of link plates corresponds to a primary chain element of the plurality of chain elements;

wherein the second link plate of the plurality of link plates corresponds to an adjacent chain element of the plurality of chain elements;

wherein the adjacent chain element is adjacent to the primary chain element; and wherein the drawing tool of the plurality of drawing tools corresponding to the primary chain element rests on the second drawing tool support when the drawing tool of the plurality of drawing tools corresponding to the primary chain element passes through a main drawing area of the drawing machine.

6. The drawing machine according to claim 1, wherein each chain element of the plurality of chain elements comprises at least one link plate;

wherein each drawing tool of the plurality of drawing tools is a frictional connection facility for frictional connection between at least one link plate of the plurality of link plates and the longitudinal workpiece to be drawn during operation of the drawing machine; and wherein each link plate applies a pressing-on force required for frictional connection.

7. The drawing machine according to claim 1, wherein the sprocket chain is a tooth-type chain.

8. The drawing machine according to claim 1, further comprising a sprocket having a sprocket circumference, having a plurality of first teeth, and having a plurality of second teeth;

wherein the plurality of first teeth and the plurality of second teeth run vertically to a circulating direction of the sprocket chain;

wherein the plurality of first teeth are arranged in a plurality of first rows;

wherein the plurality of second teeth are arranged in a plurality of second rows; and wherein each first row of the plurality of first rows is arranged offset relative to a second row of the plurality of second rows.

9. The drawing machine according to claim 8, wherein a first row of the plurality of first rows is arranged offset relative to a second row of the plurality of second rows by the thickness of a sprocket tooth.

10. The drawing machine according to claim 1, further comprising a sprocket formed of a plurality of first sprocket blades and formed of a plurality of second sprocket blades;

wherein each first sprocket blade of the plurality of first socket blades comprises first sprocket teeth;

wherein each second sprocket blade of the plurality of second socket blades comprises second sprocket teeth;

wherein the first sprocket teeth are arranged in a plurality of first rows;

wherein the second sprocket teeth are arranged in a plurality of second rows;

wherein the first sprocket teeth and the second sprocket teeth are arranged vertically to a circulating direction of the sprocket; and wherein each first row of the plurality of first rows is arranged offset relative to a second row of the plurality of second rows.

11. The drawing machine according to claim 10, wherein each first sprocket blade of the plurality of first sprocket blades and each second sprocket blade of the plurality of second sprocket blades are identical.

12. The drawing machine according to that claim 10, wherein the plurality of first sprocket blades and the plurality of second sprocket blades are combined twisted by an angle relative to one another in the sprocket such that transverse to the circulating direction of the sprocket between a first row of the plurality of first rows and a second row of the plurality of second rows a component free space is formed.

13. The drawing machine according to claim 12, wherein each front sprocket tooth of the front sprocket teeth and each second sprocket tooth of the second sprocket teeth have the same axial height; and wherein the component free space forms an accommodation area for a chain element of the plurality of chain elements of the sprocket chain.

14. The drawing machine according to claim 13, wherein the accommodation area has at least a thickness of a first sprocket tooth of the first procket teeth or a thickness of a second sprocket tooth of the second sprocket teeth, a thickness of a first sprocket blade or a thickness of a second sprocket blade, or a thickness of a sprocket tooth of the first sprocket teeth or a second sprocket tooth of the second sprocket teeth and a thickness of a first sprocket blade or a thickness of a second sprocket blade.

15. The drawing machine according to claim 13, wherein the accommodation area has at least a thickness of a chain element of the plurality of chain elements of the sprocket chain.

16. The drawing machine according to claim 13, wherein each chain element of the plurality of chain elements further comprises recess-free areas of attack; and wherein a chain element of the plurality of chain elements is arranged in the accommodation area such that at least one of a first sprocket tooth of the first sprocket teeth or a second sprocket tooth of the second sprocket teeth is exclusively in contact with the recess-free areas of attack of a chain element of the plurality of chain elements.

17. The drawing machine according to claim 10, wherein at least one first sprocket tooth of the first sprocket teeth merely has working connections in areas of attack of the first chain element of the plurality of chain elements;

wherein the areas of attack are arranged outside an intermediate area of the chain element of the plurality of chain elements; and wherein the intermediate area is largely arranged between the first chain element of the plurality of chain elements and the second chain element of the plurality of chain elements.

18. The drawing machine according to claim 1, further comprising a sprocket;

wherein each chain element of the plurality of chain elements comprises a straight or flat sliding area facing the sprocket.

19. The drawing machine according to claim 18, further comprising a frame, a sliding and support zone, and a main drawing area;

wherein each straight or flat sliding area of each chain element of the plurality of chain elements at least in the main drawing area corresponds to the frame or the sliding and support zone.

20. The drawing machine according to claim 1, further comprising a sprocket having a sprocket tooth and further comprising a working area;

wherein the sprocket tooth is flanked by two chain elements of the plurality of chain elements at least in the working area.

21. A drawing machine for drawing a longitudinal workpiece, the drawing machine comprising a sprocket chain;

wherein the sprocket chain comprises a plurality of blocks, a plurality of chain elements, and a plurality of connecting links;

wherein a first chain element of the plurality of chain elements is interlinked to a second chain element of the plurality of chain elements via a first connecting link of the plurality of connecting links and to a third chain element of the plurality of chain elements via a second connecting link of the plurality of connecting links;

wherein a block of the plurality of blocks is connected to the first connecting link of the plurality of connecting links at at least a first connecting point and a second connecting point;

wherein the block of the plurality of blocks is connected to the second connecting link of the plurality of connecting links at at least a third connecting point and a fourth connecting point;

wherein the first connecting point is adjacently arranged and interspaced relative to the second connecting point;

wherein the third connecting point is adjacently arranged and interspaced relative to the fourth connecting point; and wherein an adjacent chain element of the plurality of chain elements has a first adjacent connecting point to the first connecting link arranged between the first connecting point and the second connecting point, and has a second adjacent connecting point to the second connecting link between the third connecting point and the fourth connecting point.

22. A drawing machine for drawing a longitudinal workpiece, the drawing machine comprising a sprocket chain, a plurality of drawing tools, a pressing-on device, and a frame;

wherein the sprocket chain comprises a plurality of chain elements and a plurality of connecting links linking the chain elements of the plurality of chain elements;

wherein a drawing tool of the plurality of drawing tools is attached to a chain element of the plurality of chain elements;

wherein each drawing tool of the plurality of drawing tools is a frictional connection facility for frictional connection between the sprocket chain and the longitudinal workpiece;

wherein the pressing-on device applies a pressing-on force required for a frame frictional connection applied by the frame;

wherein the pressing-on force acts directly on a chain element of the plurality of chain elements; and wherein each drawing tool of the plurality of drawing tools is in direct contact with a respective connecting link of the plurality of connecting links via at least two connecting pins.

23. A drawing machine for drawing a longitudinal workpiece, the drawing machine comprising a sprocket chain and a plurality of drawing tools;

wherein the sprocket chain comprises a plurality of link plates, a plurality of chain elements, and a plurality of connecting links;

wherein the sprocket chain carries the plurality of drawing tools;

wherein a first chain element of the plurality of chain elements is interlinked to a second chain element of the plurality of chain elements via a first connecting link of the plurality of connecting links and to a third chain element of the plurality of chain elements via a second connecting link of the plurality of connecting links; and wherein each drawing tool of the plurality of drawing tools is attached to at least one link plate of the plurality of link plates.

24. A method for drawing comprising the steps of:

providing a drawing machine comprising a sprocket chain and a plurality of drawing tools; and drawing a longitudinal workpiece using the drawing machine;

wherein the sprocket chain carries the plurality of drawing tools;

wherein the sprocket chain comprises a plurality of chain elements and a plurality of connecting links;

wherein a first chain element of the plurality of chain elements is linked to a second chain element of the plurality of chain elements via a first connecting link;

wherein a corresponding drawing tool of the plurality of drawing tools corresponds to a corresponding connecting link of the plurality of connecting links;

wherein each drawing tool of the plurality of drawing tools corresponds to a respective chain element of the plurality of chain elements;

wherein drawing forces from the corresponding drawing tool of the plurality of drawing tools are directly directed into at least the corresponding connecting link of the plurality of connecting links;

wherein the drawing forces from the corresponding drawing tool of the plurality of drawing tools are introduced into the corresponding connecting link of the plurality of connecting links by way of at least two connecting points;

wherein a chain element of the plurality of chain elements not directly connected with the corresponding drawing tool of the plurality of drawing tools is arranged at a third connecting point to the corresponding connecting link of the plurality of connecting links; and wherein the third connecting point is on the corresponding connecting link between the at least two connecting points.

25. The method according to claim 24, wherein the sprocket chain is a pitch chain comprising link plates;

wherein by at least the pitch chain a frictional connection is formed between the pitch chain and the longitudinal workpiece; and wherein a pressing-on force required for the frictional connection is applied via the link plates of the pitch chain.

26. A method for drawing comprising the steps of:

providing a drawing machine comprising a sprocket chain and a plurality of drawing tools; and drawing a longitudinal workpiece using the drawing machine;

wherein the sprocket chain carries the plurality of drawing tools;

wherein the sprocket chain comprises a plurality of chain elements and a plurality of connecting links;

wherein a first chain element of the plurality of chain elements is linked to a second chain element of the plurality of chain elements via a first connecting link of the plurality of connecting links;

wherein a corresponding drawing tool of the plurality of drawing tools corresponds to a corresponding chain element of the plurality of chain elements and to a corresponding connecting link of the plurality of connecting links;

wherein drawing forces from the corresponding drawing tool are directly directed into at least the corresponding connecting link of the plurality of connecting links;

wherein the longitudinal workpiece is frictionally gripped by the sprocket chain;

wherein pressing-on forces required for s frictional connection are applied by a frame;

wherein the pressing-on forces directly act on a chain element of the plurality of chain elements; and wherein the drawing forces from the corresponding drawing tool are introduced into the corresponding connecting link by way of at least two connecting pins.

27. A method for drawing comprising the steps of:

providing a drawing machine comprising a sprocket chain; and drawing a longitudinal workpiece using the drawing machine;

wherein drawing forces required for the drawing are generated by at least the sprocket chain;

wherein the sprocket chain comprises a plurality of link plates, a plurality of chain elements, and a plurality of connecting links;

wherein the drawing forces are introduced by the longitudinal workpiece via the link plates into the sprocket chain; and wherein a first chain element of the plurality of chain elements is interlinked to a second chain element of the plurality of chain elements via a first connecting link of the plurality of connecting links and to a third chain element of the plurality of chain elements via a second connecting link of the plurality of connecting links.

* * * * *